US006685271B1

(12) United States Patent
Chang

(10) Patent No.: US 6,685,271 B1
(45) Date of Patent: Feb. 3, 2004

(54) CHAIR SUPPORT DEVICE HAVING MOVABLE FOOT PEDAL

(76) Inventor: Horng Jiun Chang, P.O. Box 63-99, Taichung (TW), 406

( * ) Notice: Subject to any disclaimer, the term of this patent is extended or adjusted under 35 U.S.C. 154(b) by 0 days.

(21) Appl. No.: 10/402,803

(22) Filed: Mar. 26, 2003

(51) Int. Cl.[7] ..... A47C 16/00

(52) U.S. Cl. ..... 297/423.4; 297/423.46; 297/423.44; 297/423.36

(58) Field of Search ..... 297/423.26, 423.34, 297/423.36, 423.39, 423.4, 423.41, 423.44, 423.46

(56) References Cited

U.S. PATENT DOCUMENTS 5,352,020 A * 10/1994 Wade et al.
5,507,562 A * 4/1996 Wieland
5,560,681 A * 10/1996 Dixon et al.
6,030,033 A * 2/2000 Schultz
6,267,445 B1 * 7/2001 Marais

* cited by examiner

*Primary Examiner*—Milton Nelson, Jr.

(57) ABSTRACT

A chair support device includes a frame having a rear portion pivotally secured to a front portion of a base and movable relative to the base between a downward folding position and a working position. A foot pedal is slidably supported on the frame and movable forwardly and rearwardly relative to the frame. A rotating device may rotate the frame between the downward folding position and the working position, to move the foot pedal forwardly relative to the frame when the frame is rotated toward the working position, in order to comfortably support the feet of the users.

4 Claims, 4 Drawing Sheets

CHAIR SUPPORT DEVICE HAVING MOVABLE FOOT PEDAL

BACKGROUND OF THE INVENTION

1. Field of the Invention

The present invention relates to a chair support device, and more particularly to a chair support device having a movable foot pedal device to comfortably support feet of users.

2. Description of the Prior Art

Typical chairs have no support devices to support feet portions of users, such that the users may not be comfortably supported on the chairs.

For massage chairs or the like, several support devices have been developed to support the feet portions of the users, while the users are massaged by the massage chairs. However, the support devices are solidly attached to the chair bases and may not be adjusted relative to the chair bases, such that the support devices may not be used to comfortably support the feet portions of the users.

The present invention has arisen to mitigate and/or obviate the afore-described disadvantages of the conventional chair support devices.

SUMMARY OF THE INVENTION

The primary objective of the present invention is to provide a chair support device including a movable or adjustable foot pedal device to comfortably support feet of users.

In accordance with one aspect of the invention, there is provided a chair support device comprising a base including a front portion and a lower portion, a frame including a rear portion pivotally secured to the front portion of the base with a pivot axle, and movable relative to the base between a downward folding position and a working position, a foot pedal slidably supported on the frame and movable forwardly and rearwardly relative to the frame, and a rotating device provided for rotating the frame between the downward folding position and the working position, to move the foot pedal forwardly relative to the frame when the frame is rotated toward the working position, and to move the foot pedal rearwardly relative to the frame when the frame is rotated toward the downward folding position. The foot pedal may thus be forced to slide forwardly relative to the frame to a forward or working position, to suitably or comfortably support the feet of the users, and may also slide rearwardly relative to the frame to a folding or storing position, when the frame and the foot pedal are rotated downwardly relative to the base toward the downward folding position.

The frame includes at least one rail provided thereon, the foot pedal includes at least one track provided thereon, and slidably engaged with the rail of the frame, to guide the foot pedal to move relative to the frame.

The rotating device includes an actuator coupled between the base and the frame, to rotate the frame relative to the base about the pivot axle, and between the downward folding position and the working position. The rotating device further includes a lever having a first end pivotally secured to the base, and a coupling device may further be provided for coupling the lever to the foot pedal.

The lever includes a second end, the coupling device includes a link having a middle portion pivotally secured to the base, and having a first end pivotally secured to the second end of the lever, and having a second end coupled to the foot pedal.

The foot pedal includes at least one flap having a channel formed therein, the link includes a shaft attached to the second end thereof, and slidably received in the channel of the flap, for guiding the foot pedal to move relative to the frame and the base.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
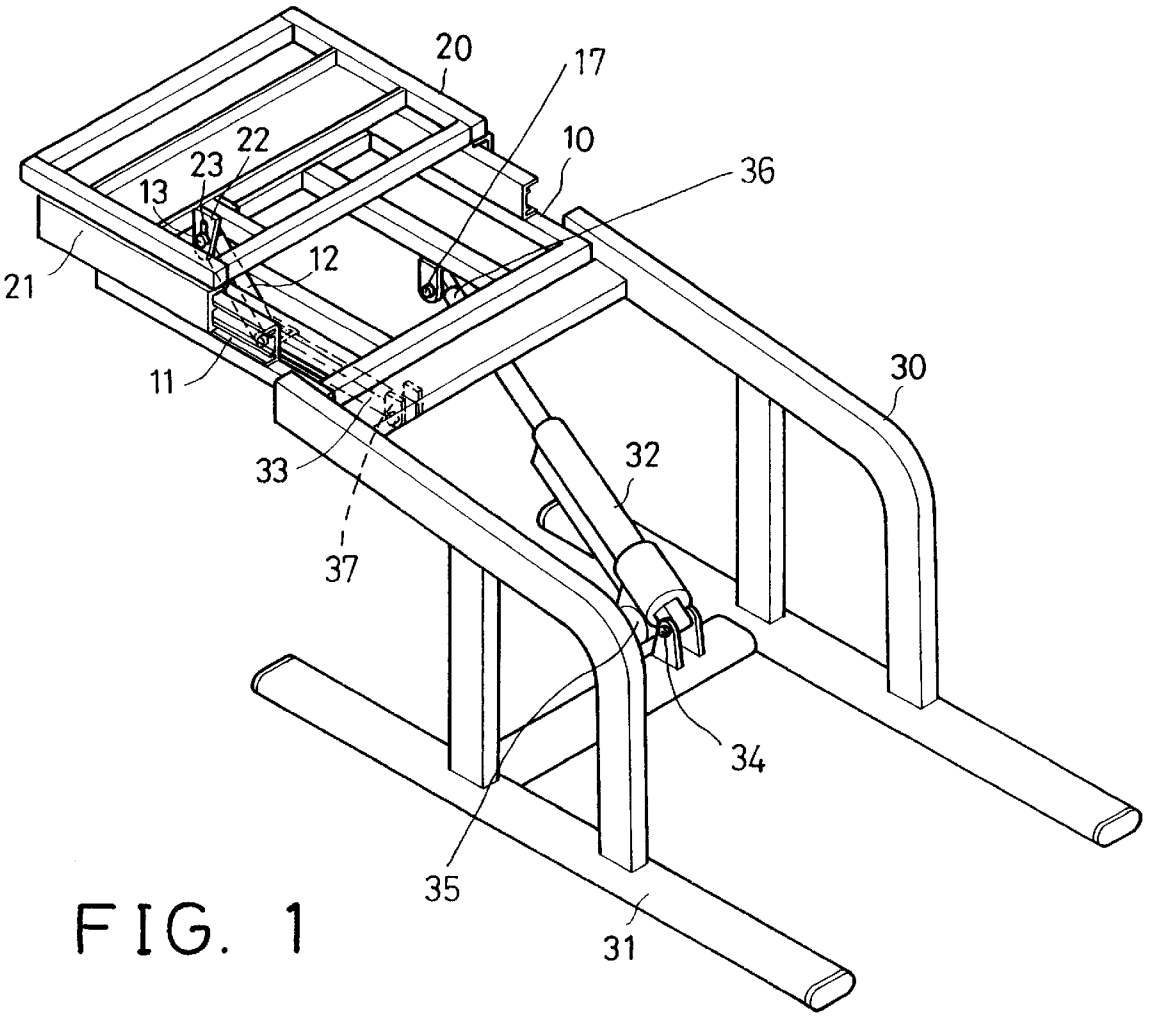
FIG. 1 is a perspective view of a chair support device in accordance with the present invention.
Figure 2:
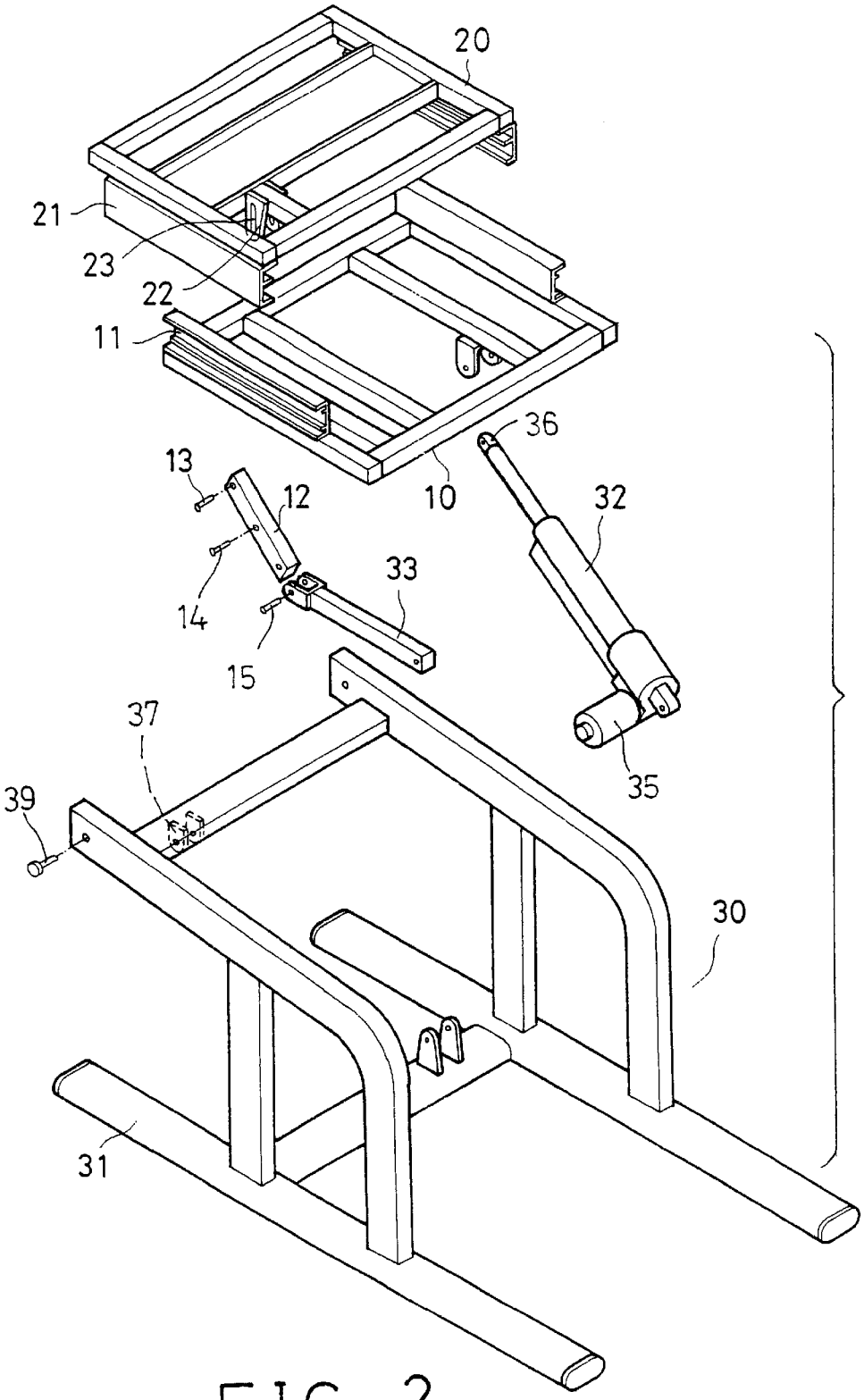
FIG. 2 is an exploded view of the chair support device.
Figure 3:
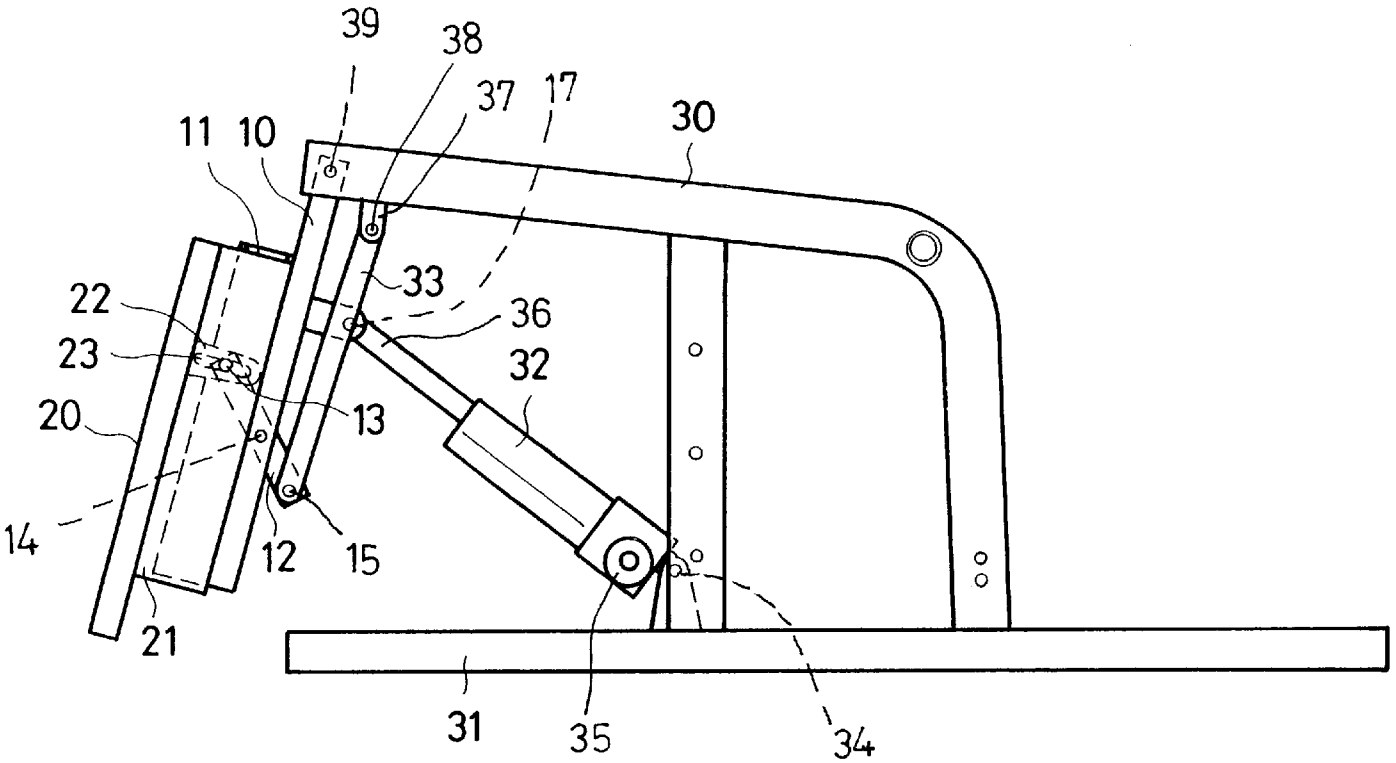
FIG. 3 is a side plan view of the chair support device, illustrating the folding position of the chair support device.

Referring to the drawings, and initially to FIGS. 1–3, a chair support device in accordance with the present invention comprises a base 30 for supporting a chair device (not shown), such as a massage chair device. An actuator 32 has one end rotatably or pivotally secured to the bottom portion 31 of the base 30 with a pivot spindle 34.

The actuator 32 may be a pneumatic or hydraulic cylinder, or a motor-driven mechanism having a motor 35 attached thereto, to actuate the actuator 32 to be extended (FIGS. 1, 4) or to be retracted (FIG. 3), when required. A lever 33 has one end rotatably or pivotally secured to the upper portion of the base 30 with a bracket 37 and/or a pivot pin 38, for allowing the lever 33 to be rotated relative to the base 30 about the pivot pin 38.

Figure 4:
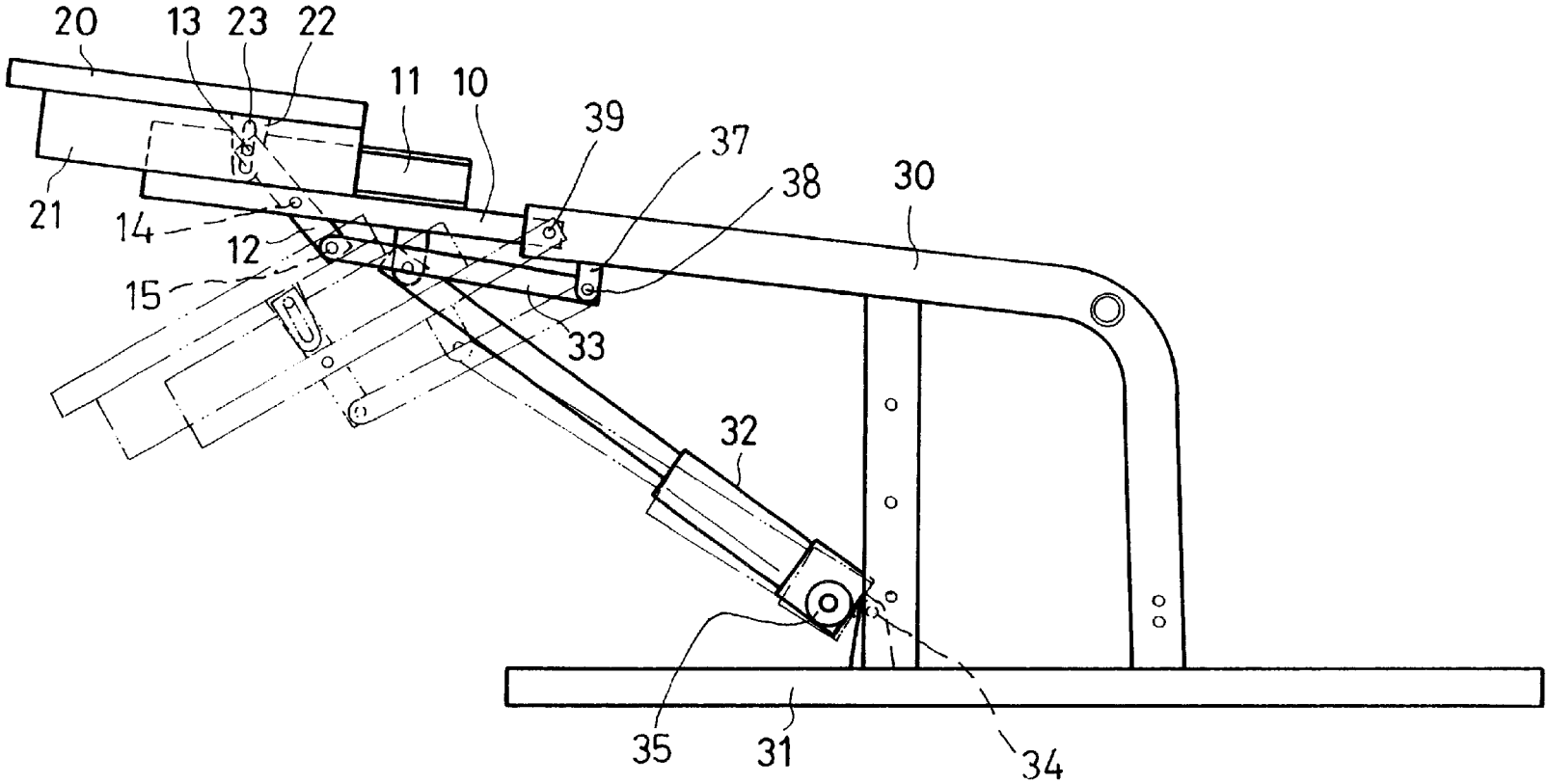
FIG. 4 is a side plan view similar to FIG. 3, illustrating the operation of the chair support device.

A frame 10 includes one portion, such as the rear portion thereof rotatably or pivotally secured to the upper or front portion of the base 30 with a pivot axle 39, for allowing the frame 10 to be rotated relative to the base 30, about the pivot axle 39, and from a downward or folding position (FIG. 3) toward an upward or forward working position (FIGS. 1, 4).

The other end 36 of the actuator 32 is rotatably or pivotally secured to the frame 10 with a pivot rod 17, for allowing the frame 10 to be rotated relative to the base 30 and between the downward or folding position and the upward or working position (FIGS. 1, 4) by the actuator 32. The frame 10 includes one or more tracks or rails 11 provided thereon, such as provided on the upper portion thereof.

A link 12 includes a shaft 13 provided or attached to one end, such as the front end thereof, and includes a middle portion rotatably or pivotally secured to the frame 10 with a pivot pole 14, and includes the other end rotatably or pivotally secured to the other end or the rear end of the lever 33 with a pivot column 15, for allowing the frame 10 and the link 12 and the lever 33 to form a crisscross-like structure.

A foot pedal 20 is slidably supported on the frame 10, and includes one or more rails or tracks 21 provided thereon, such as provided on the lower portion thereof, to slidably engage with the corresponding rails 11 of the frame 10, and to guide the foot pedal 20 to slide or move relative to the frame 10, and thus relative to the base 30.

The foot pedal 20 includes one or more, such as two flaps 22 provided thereon, such as provided on the lower portion thereof. The flaps 22 each may include an oblong hole or a channel 23 formed therein to slidably receiving the shaft 13 therein, and thus for allowing the front end portion of the link 12 or the shaft 13 to move up and down relative to the flaps 22 or the foot pedal 20.

In operation, as shown in FIG. 3, when the actuator 32 is retracted to rotate the frame 10 to the downward or folding position, the lever 33 may rotate the link 12 relative to the frame 10, to push or force the rear end of the link 12 forwardly relative to the frame 10, and thus to force the front end or the shaft 13 to move rearwardly relative to the frame 10, in order to move the foot pedal 20 rearwardly relative to the frame 10 to the folding or retracting position.

As shown in FIGS. 1 and 4, when the actuator 32 is actuated or extended to rotate the frame 10 toward the upward or working position, the lever 33 may rotate the link 12 relative to the frame 10, to push or force the rear end of the link 12 rearwardly relative to the frame 10, and thus to force the front end or the shaft 13 to move forwardly relative to the frame 10, in order to move the foot pedal 20 forwardly relative to the frame 10 to the forward or working position.

The chair support device thus may include a foot pedal 20 that may be slid forwardly relative to a frame 10 to a forward or working position, to suitably or comfortably support the feet of the users, and that may be slid rearwardly relative to a frame 10 to a folding or storing position, when the frame 10 and the foot pedal 20 are rotated downwardly relative to the base 30 toward the downward folding position.

Accordingly, the chair support device in accordance with the present invention includes a movable or adjustable foot pedal device to comfortably support feet of users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A chair support device comprising:

a base including a front portion and a lower portion, a frame including a rear portion pivotally secured to said front portion of said base with a pivot axle, and movable relative to said base between a downward folding position and a working position, a foot pedal slidably supported on said frame and movable forwardly and rearwardly relative to said frame, and means for rotating said frame between said downward folding position and said working position, to move said foot pedal forwardly relative to said frame when said frame is rotated toward said working position, and to move said foot pedal rearwardly relative to said frame when said frame is rotated toward said downward folding position, said rotating means further including a lever having a first end pivotally secured to said base and having a second end, and means for coupling said lever to said foot pedal, said coupling means including a link having a middle portion pivotally secured to said base, and having a first end pivotally secured to said second end of said lever, and having a second end coupled to said foot pedal.

2. The chair support device as claimed in claim 1, wherein said frame includes at least one rail provided thereon, said foot pedal includes at least one track provided thereon, and slidably engaged with said at least one rail of said frame, to guide said foot pedal to move relative to said frame.

3. The chair support device as claimed in claim 1, wherein said rotating means includes an actuator coupled between said base and said frame, to rotate said frame relative to said base about said pivot axle, and between said downward folding position and said working position.

4. The chair support device as claimed in claim 1, wherein said foot pedal includes at least one flap having a channel formed therein, said link includes a shaft attached to said second end thereof, and slidably received in said channel of said at least one flap.

* * * * *